US006800319B1

(12) United States Patent
Hulst et al.

(10) Patent No.: US 6,800,319 B1
(45) Date of Patent: Oct. 5, 2004

(54) ACCESSING LEAF AND/OR STEM PARTS OF PLANTS

(75) Inventors: Anne Coenraad Hulst, Gieten (NL); Jan Josef M. H. Ketelaars, Wageningen (NL); Johan Pieter M. Sanders, Groningen (NL)

(73) Assignee: Cooperatieve Verkoop-en Productievereniging van Aardappelmeel en Derivaten AVEBE B.A., Ja Veendam (NL)

( * ) Notice: Subject to any disclaimer, the term of this patent is extended or adjusted under 35 U.S.C. 154(b) by 0 days.

(21) Appl. No.: 09/869,409

(22) PCT Filed: Dec. 24, 1999

(86) PCT No.: PCT/NL99/00804

§ 371 (c)(1),
(2), (4) Date: Aug. 31, 2001

(87) PCT Pub. No.: WO00/40787

PCT Pub. Date: Jul. 13, 2000

(30) Foreign Application Priority Data

Jan. 6, 1999 (NL) ..... 1010975

(51) Int. Cl.[7] ..... A23J 3/14

(52) U.S. Cl. ..... 426/656; 162/24; 162/91; 162/97; 162/98; 99/537

(58) Field of Search ..... 426/656; 162/24, 162/91, 97, 98; 99/537

(56) References Cited

U.S. PATENT DOCUMENTS

| | | | | | |
|---|---|---|---|---|---|
| 1,181,553 | A | * | 5/1916 | Taylor et al. | 162/11 |
| 2,459,901 | A | * | 1/1949 | Stout | 426/599 |
| 3,682,092 | A | * | 8/1972 | Breton et al. | 100/52 |
| 4,481,355 | A | | 11/1984 | Jaskowski | |
| 5,464,160 | A | | 11/1995 | McDonald et al. | |
| 5,830,738 | A | * | 11/1998 | Thomas et al. | 209/209 |
| 5,958,182 | A | * | 9/1999 | Hondroulis et al. | 162/24 |

FOREIGN PATENT DOCUMENTS

| | | |
|---|---|---|
| GB | 658129 | 10/1951 |
| NL | 52591 | 1/1942 |

* cited by examiner

*Primary Examiner*—Anthony Weier
(74) *Attorney, Agent, or Firm*—Hoffmann & Baron, LLP

(57) ABSTRACT

The invention relates to the separation and of components from vegetable raw materials. The invention provides a method for separating components from vegetable material which has at least leaf and/or stem parts, characterized in that the material is at least partly fiberized and subsequently is separated into a fiber fraction and a juice stream, such that the fiber fraction principally has relatively firm tissues such as epidermis, sclerenchyma and vascular bundles, and the juice stream principally contains soft tissues such as parenchyma and cytosol. In preferred embodiment, the invention provides a method for separating a juice stream which has in particular chloroplasts.

25 Claims, 7 Drawing Sheets

ACCESSING LEAF AND/OR STEM PARTS OF PLANTS

BACKGROUND OF THE INVENTION

The invention relates to the separation and recovery of components from vegetable raw materials.

Plants, like most organisms, are made up of cells. A plant cell consists of a Lipid membrane with a generally aqueous content, the cytosol, which contains the various cell organelles (likewise surrounded by lipid membranes), such as nucleus, mitochondria, endoplasmic reticulum and chloroplasts, and the cytoskeleton, made up of microfilaments and microtubules, which gives the cell an inner structure. Also present in the plant cell are vacuoles which play an important role in keeping the plant cell under tension; the vacuoles maintain the turgor of the cell.

The constituent components of a plant cell can be roughly distinguished into water, which accounts for the greater part by far of a living cell, components such as salts, (precursors of) lipids, carbohydrates, amino acids and nucleotides, macromolecules such as starches, proteins and nucleic acid and a multiplicity of other molecules, including vitamins and pigments such as chlorophyll, carotene and xanthophyll.

A plant cell is generally surrounded by a cell wall which provides firmness and structure to the plant tissue. The cell wall is mainly built up from (hemi)cellulose and other carbohydrate polymers, which have aggregated to fibers. Woody plants further contain an ample amount of lignin, a polymer made up of phenols and other aromatic monomers.

Plant tissue is made up of plant cells, all of which, when living, basically satisfy the above description. An important distinction can be made between relatively firm tissues which comprise virtually no chloroplast or other plastid containing cells, and the relatively soft tissues which generally do. Tissues which generally comprise no chloroplast containing cells are, for instance, the epidermis or skin tissue of a plant, the collenchyma and sclerenchyma or stroma of a plant and the vascular fiber bundles or the vascular tissue, comprising the important transport vessels (wood vessels and sieve tubes) in the plant. When a part of a plant is strongly lignified, in general, over time, the majority of the cells in the lignified part die off and only residues of the cell content are left. In particular the cytosol and the organelles present therein are lost, but the vascular fiber bundles, skin and stromas generally give the plant form and structure and generally remain present when the plant is dead. Characteristically, these relatively firm tissues (in particular vascular bundles, sclerenchyma and epidermis) comprise no to virtually no chloroplast containing cells, while an important part (at least in the aerial leaf and stem parts of the plant) of the relatively soft tissues, also called chlorenchyma, is made up chiefly of only chloroplast-containing parenchymal cells; indeed, this is where photosynthesis occurs.

It has long been known to recover various components from vegetable raw materials for further use in, for instance, food for human or feed for animal consumption through mechanical methods. Often, plants are merely comminuted or chopped to make them suitable for consumption, an example being the chopping of maize for feed.

However, in particular the components present in the plant cell cytosol are outstandingly suitable for human food or animal feed, since these can be building materials for corresponding components which are found in animal cells.

Mechanical processing is applied, for instance, to feed crops, such as grass, lucerne and other fresh and green harvested plants which, often as virtually whole plant, in particular the leaf and/or stem parts and in most cases not including the roots, are used for recovering, for instance, (animal) feed components. Such vegetable raw materials are generally recovered through pressing of (preferably chopped or otherwise comminuted) leaf and/or stem material, whereby a part of the vegetable material is obtained as press juice, while the residual and pressed material is known as press cake.

The pressure forces exerted by pressing generally result in the opening up (snapping or bursting) of plant cells in the material, so that the aqueous but food component-rich cytosol, possibly with residues of the organelles and the lipid membrane surrounding the cell, is liberated from the cell as press juice. Press juice is generally treated further, for instance through screening, whereafter, for instance, the protein in the juice is recovered by means of coagulation through, for instance, acid and/or heat treatment. Press juice may also be further processed through (ultra or membrane) filtration, drying, fermentation or other methods known to the skilled person. Protein-rich or otherwise high-grade nutrients for human and animal consumption, but also pigments such as carotene (provitamin A), can be recovered from cytosol in this way.

The resultant, relatively dry press cake is generally considered to be less rich in food; it contains relatively intact fiber bundles composed of (not directly) digestible cellulose fibers, adherent press juice and residual plant cells which have not been accessed under the influence of the pressing. Especially these residual plant cells with unrecovered cytosol give fodder value to the press cake, which is generally dried and, pelleted or otherwise, is used as relatively low-grade roughage component in fodders, in particular for ruminants.

For mechanically accessing, for instance, lucerne or grasses, traditionally a method is used which is based on the disintegration of the vegetable raw material by means of hammer mills followed by squeezing the disintegrated raw material (here designated as pulp) using screw presses or belt presses. The pulp is thereby separated into a press cake fraction and a press juice fraction. The juice fraction is regarded as the fraction in which the industrially recoverable content substances from the plant material are contained. Hammer mills typically consist of a rotor on which fixed of freely movable elements are disposed which upon rotation of the rotor are brought into contact with the vegetable raw material and disintegrate it through force of impact. The disintegratory effect of hammer mills is relatively large when the vegetable material has a good turgor, i.e. when the plant cells are under tension. In that case, the force of impact causes the tissue to snap and causes the cell content constituents to be liberated with the tissue fluid. If turgor is low, beating the plant material will cause it to be compressed. The tissue then remains more or less intact and the result is that the cell content becomes available to a much lesser extent. This has major consequences for the recoverability of particularly those cell content constituents that are present in the vegetable biomass only partly in dissolved form and for another part in the form of solid, undissolved matter. This holds true inter alia for vegetable proteins, but also for lipids and pigments. Also known (for instance from U.S. Pat. No. 5,464,160) are hammer mills where relatively dry material is separated into two fractions, this while neglecting the so valuable juice stream with protein-rich cytosol. Accordingly, these types of mills are not suitable for processing fresh, relatively wet material and eventually produce a relatively wet fiber fraction.

In the above-described methods of pressing vegetable material which contains at least leaf and/or stem parts, it is generally of importance that the material be processed while still as fresh as possible, shortly after harvesting. Only then are the plant cells sufficiently under tension to be able to burst or snap under pressure so that the cytosol is liberated. When, after harvesting, already some time has elapsed before the plant parts are pressed, they are already dried out to some extent by then, the plant cells present have lost a large part of the necessary turgor and are too slack to be able to snap or burst under pressure. Accordingly, in non-fresh material, the recovery of press juice will proceed with less efficiency. The same holds for material stemming from plants which, even before they were harvested, already lost a large part of the turgor in their plant cells through drying out and/or maturation. In general, such plants are not (completely) green anymore but acquire brown or yellow aspects. Lignified plant parts are altogether ineligible for the above methods, since most cells have died off in them, or in any case they contain only a very minor cytosol fraction and hence do not contribute to the recovery of high-grade food.

In general, plant material is separated into a press cake fraction and a press juice fraction. Characteristic of this method is the only partial extraction (along with the press juice) of the cell content constituents (vacuole content and cytoplasm with cell organelles present therein, such as chloroplasts and cell nuclei); the cell walls are substantially completely left behind in the press cake together with the remainder of the cell content. Contained in the press cake are all tissues which are also contained in the raw material, and in addition also a part of the cell content. The color of the fresh press cake is predominantly green in that the chloroplasts having therein the chlorophyll (leaf green) present, have only been partly removed with the press juice. The plant material has only partly disintegrated down to tissue level; this means that still recognizable fragments of leaves and stems are present in addition to individual tissues such as isolated vascular bundles.

The press juice consists substantially of the aqueous content of cells: the vacuole content and the cytoplasm having therein cell organelles such as chloroplasts in intact or disintegrated form; cell wall constituents are substantially absent in that they remain behind in the press cake.

Consequently, the recoverability of protein and other partly soluble substances in the traditional method of fractionation is highly susceptible to variations in the nature of the vegetable biomass, in particular the presence of turgor, which is typically reflected in differences in dry matter content.

The traditional method of fractionation has as a consequence that upon squeezing the pulp, only a part of the cell content constituents end up in the juice stream and another part remains behind in the press cake. Accordingly, the press cake still contains, in addition to the greater part of the cell walls, a part of the cell content constituents and, by virtue of that, is used as fodder.

The existing pressing methods for separating high-grade from low-grade components from vegetable material are therefore relatively strongly dependent on the turgor of the cells present in the vegetable material, which limits the application of these methods to their application to relatively fresh and green material. Often, the resultant press cake, also when fresh and/or green material is used, still contains large amounts of unaccessed plant cells with high-grade cytosol in them, while only a low price can be obtained for press cake since it is in fact suitable only as a relatively low-grade component of animal fodder. For recovering high-grade components from leaf and/or stem parts, there is a need for better methods which can access the plant cell with a higher efficiency than the existing methods, can make the cytosol fraction more available for recovery, and affords better marketing possibilities for the fiber-containing residual material. The object of the invention is to provide for this need.

SUMMARY OF THE INVENTION

The invention provides a method for separation of components from vegetable material, such as leaf and/or stem parts, characterized in that the material is at the least partly fiberized and subsequently is separated into a fiber fraction and a juice stream, such that the fiber fraction chiefly comprises relatively firm tissues such as epidermis, sclerenchyma and vascular bundles, and the juice stream chiefly contains soft tissues such as parenchyma, and cytosol. In a preferred embodiment, the invention provides a method for separating a juice stream comprising in particular parenchyma with chloroplasts.

The invention provides a new method of fractionation which consists of at least two steps: a first step in which the vegetable material is fiberized through the action of shear forces and a second step in which the fiber fraction is separated from the rest. Fractionation of vegetable biomass means the separation into a number of fractions. By fractionating biomass, new product streams are formed with other application possibilities than the raw material itself. Consequently, these new product streams jointly often represent more value than the original biomass. The invention provides a new technique which is based on fiberization and subsequent defibration of vegetable biomass.

In a preferred embodiment, the invention provides a method for separation of components from vegetable material, characterized in that the material is at the least partly mechanically fiberized and subsequently is separated into a fiber fraction and a juice stream, with the fiber fraction (see, for instance, FIGS. 1 and 2, also for a comparison with a traditional method) principally comprising relatively firm tissues such as epidermis, sclerenchyma and vascular bundles, and the juice stream (see, for instance, FIGS. 6 and 7, also for a comparison with a traditional method) principally containing soft tissues such as parenchyma, and cytosol. The mechanical fiberization is effected, for instance, through treatment of the material in a blender. Preferably, certainly when application on an industrial scale is desired, the fiberization is done, according to the invention, with an apparatus such as a (pressure) refiner, with grinding disks, such as employed in the pulp and paper industry, or in an apparatus of equivalent action by which the vegetable material can be fiberized to enable separation into a fiber fraction which principally comprises relatively firm tissues such as epidermis, sclerenchyma and vascular bundles, and the juice stream principally comprising soft tissues such as parenchyma, and cytosol.

The method according to the invention is applicable to all fiber containing vegetable materials, originating both from cultivated plants (crop plants) and from wild plants, as well as to crossing products of cultivated plants among themselves or with wild plants. Examples are: vegetable biomass originating from cultivated grassland, but also from natural grounds and roadsides, feed crops such as forage grasses and corn, lucerne, clover, and other papilionaceous plants, fiber crops such as flax and hemp, and the tops of crops normally grown solely for their seeds, fruits or tubers, such as grains, beets, peas, beans, potatoes, carrots, cassava, sweet potato.

DETAILED DESCRIPTION OF THE INVENTION

In fiberization, the vascular tissue with the sclerenchyma and the epidermis (jointly the fiber fraction) is mechanically dissociated from the other, substantially parenchymal tissue. This parenchymal tissue is at the same time accessed and the cell content constituents from it thereby become available substantially completely. Fiberization can be done using refiners such as they are in use in the pulp and paper industry for fiberizing wood and wood pulp. Refining, or fiberization, typically occurs with addition of moisture to the plant material. The result is then a slurry of fiberized material from which the fibers can be removed. The fiber fraction (fiber stream) which is thus recovered, is suitable, through its nature and composition, inter alia for the following applications: as raw material for paper and cardboard (solid cardboard, folding cardboard and form cardboard), as raw material for the production of fiberboard materials (softboard, hardboard, chipboard, MDF, HDF and MDF/HDF form parts) and composites, as raw material for moisture absorbing materials, such as diapers, sanitary napkins, and so forth, as raw material for the preparation of growth media (potting compost and substrates), mulches (as protection against erosion, and as weed and disease suppressant), as soil improver or as fuel.

In defibration, the liberated fiber is separated, for instance through screening, from the other plant constituents. Through washing and screening, the fiber can be further purified and as many non-fiber constituents as possible can still be recovered with the washing water. The defibered slurry then consists of a mixture of added water, tissue fluid, cell content constituents and finely dispersed cell walls coming from the parenchymal tissue. From the defibered slurry or juice stream, content substances can be recovered in a more or less pure form, such as: proteins, peptides and amino acids, enzymes, pigments, lipids, fatty acids, starches, soluble sugars and (cell wall) carbohydrates for use in livestock feeding, human nourishment, or as substrate for fermentations, or, through concentration, fodder or food products can be made with a high nutritive value as a result of the removal of the non-digestible or poorly digestible fiber fraction. The defibered slurry can be further fractionated in subsequent steps. One possibility is, for instance, the separation of all solid parts through centrifugation, which may or may not be preceded by a coagulation step through heating, acidification or otherwise. Another possibility is to convert the parenchymal cell walls into soluble sugars using cell wall splitting enzymes (pectinases, cellulases, etc.) and thus adding them to the fraction of dissolved substance in the defibered slurry.

Characteristic of the method as provided by the invention is the split at tissue level into a fiber fraction which contains the relatively firm tissues (vascular bundles, sclerenchyma and epidermis) and a defibered fraction which contains the relatively soft tissues (parenchyma) with their content. Briefly summarized, the difference between the traditional and novel method is the extraction of tissue fluid (traditional) versus tissue fractionation (new method).

The invention also provides an apparatus for practicing a method according to the invention. Such an apparatus is characterized by means suitable for the fiberization according to the invention, whereby the relatively firm vascular tissue with, for instance, the sclerenchyma and the epidermis (jointly the fiber fraction) is mechanically dissociated from the other, substantially parenchymal tissue. This parenchymal tissue is at the same time accessed and the cell content constituents therefrom thereby become available substantially completely. 'Fiberization' is herein understood to mean that the plant material is exposed to such forces that the relatively firm tissues are dissociated virtually completely from the relatively soft tissues. As a resultant of the forces which effect this fiberization, the great majority, if not virtually all, of the plant cells will be accessed, so that the cytosol is liberated. This cytosol, as a juice stream generally also including residues of the organelles and the cell surrounding lipid membrane and parenchymal cell walls, can be relatively simply separated from the fiber component through screening or through other separation means known to those skilled in the art.

A first advantage of the invention is that the efficiency of the method is not dependent on the turgor of the plant cells present in the material, so that the plant cells can be accessed with greater efficiency than is conventional in the above-described pressing methods.

A second advantage of the invention is that the invention provides two product streams which as such are very pure. A first one, the fiber fraction, contains principally cellulose and hemicellulose, principally consisting of the elements C, H and O (which in itself yields advantages for a clean combustion); a second one contains all valuable and complex content substances to be found in the parenchyma and cytosol, and which can be further separated relatively simply.

The two product streams can be separated from each other by, for instance, screening. Other separation methods than screening are also conceivable, for instance centrifugation, processing by (hydro)cyclone and centriscreening, and decanting or sedimentation, or combinations of these methods. In defibration, the liberated fiber is separated from the other plant constituents through, for instance, screening. By washing and screening, the fiber can be further purified and as many non-fiber constituents as possible can still be recovered with the washing water. The defibered slurry then consists of a mixture of added water, tissue fluid, cell content constituents and finely dispersed cell walls coming from the parenchymal tissue.

A first product stream as contemplated by the invention is a (generally nutritionally high-grade) juice stream consisting of an aqueous solution/suspension of virtually all high-grade components or nutrients from the vegetable material (such as sugars, fructose-oligosaccharides, proteins, lipids, pigments, and the like). Through removal of the (nutritionally low-grade) fiber components, there is formed (on a dry matter basis) this relatively high-grade product stream, from which the various components can be further isolated relatively simply. The defibered product or the juice stream consists substantially of parenchyma, partly as intact cells, partly as disintegrated cell material. The color of the defibered product is typically green due to the presence of intact or broken chloroplasts, sometimes brown-green through browning during the fractionation. Macroscopically, it is a liquid. Microscopically, principally intact and disintegrated parenchyma cells and cell organelles such as chloroplasts are visible in this liquid.

The second product stream, the fiber fraction as contemplated by the invention, consists of the relatively hard tissues. These are typically the vascular bundles, the sclerenchyma and the epidermis. The cell content is absent from these tissues or is removed virtually completely during fractionation and washing. Consequently, fiber consists predominantly of cell wall components. Chloroplasts are virtually absent in a pure fiber preparation. The color of the washed fiber typically varies from white to yellow or light-brown. Sometimes, a light-green color may arise as a result of impregnation with chlorophyll during recovery. Macroscopically, the fiber fraction has a fiber structure principally through the filamentary character of the vascular bundles. Microscopically, in addition to the filamentary structures of vascular bundles and sclerenchyma, typically, pieces of epidermis tissue are also recognizable, consisting of sheets one cell layer thick. The vascular bundles are built up from several cells including wood vessels and sieve tubes. Depending on the extent of fiberization, fibers consisting of one cell occur too, and further the residues of cell walls and (spiral, reticulate or ring-shaped) cell wall thickenings. Typical of the epidermis sheets is the presence of stomata and silicious teeth or hairs.

The fiber stream as contemplated by the invention consists substantially exclusively of a wet solid fiber stream (chiefly cellulose and hemicellulose) basically having no nutritive value, since this fraction is not directly, and microbiologically only to a slight extent, digestible. However, the absence of digestibility makes it possible to use the fiber stream for non-food applications, this in contrast to, for instance, the press cake coming from the above-described traditional pressing methods where the press cake is in fact suitable only for fodder applications and would soon rot if it were not prepared into food and was eaten or further preserved.

For example, the invention provides the use of a fiber fraction for the production of energy. The fiber fraction contains principally the carbohydrates cellulose and hemicellulose (composed principally of the elements C, H and O), which are eminently combustible and hence can be converted with a high efficiency to useful energy in, for instance, a combined heating and power station, and which may be expected to entail no or minor emission of harmful substances upon combustion. Processing plant material according to a method as contemplated by the invention, followed by the use of the resultant fiber fraction as fuel, will contribute to the reduction of the $CO_2$ emission, since what is involved here is a non-fossil fuel. Also, as such, the combustion of the fiber fraction will be cleaner for the environment, since the fiber fraction is hardly, if at all, contaminated with the salt residues (such as K, Na, Cl, P compounds) and protein residues (which include S and N compounds) normally occurring in dry plants. These salt residues and protein residues, coming from the cytosol, have been separated, along with the juice stream, from the fiber fraction. Combustion of the fiber fraction (having therein principally C, H and O compounds which are converted by combustion to $H_2O$ and $CO_2$) will therefore entail a much lesser environmental impact than combustion of other plant material in which all these salt residues and protein residues are still present. Protein combustion contributes in particular to the emission of sulfur and nitrogen compounds such as sulfur and nitrogen oxides, and incombustible salt residues will contribute to the residual ash volume. Upon combustion of a fiber fraction according to the invention, the emission of, for instance, sulfur and nitrogen oxides, and the residual ash volume having therein the salt residues will be much smaller.

Since the fiber material is of organic origin, it is also applicable, for instance, as a peat substitute in, for instance, potting soil or in horticultural substrates.

In a preferred embodiment of the invention, the plant material is fiberized to such an extent that, for instance, the fiber material consists principally of elemental fibers, so that the so obtained fiber component or fiber stream is suitable, for instance, for further processing into cardboard and/or paper, or can be used as (natural) fiber in composites together with and in reinforcement of (artificial) resins.

Examples of vegetable material that can be treated with a method according to the invention are known (fodder) crops such as grasses (grains such as wheat, rye and maize included), lucerne, hemp, but also harvest residues of crops whose leaf and/or stem parts are normally not processed, such as potato or (sugar) beet tops which are generally left behind in the field upon harvesting; or crops which are generally not processed into juice, or are so processed on a limited scale only, such as spinach, lettuce and grass. The high efficiency of a method according to the invention renders the processing of such vegetable materials profitable.

The juice stream of plant materials processed according to a method contemplated by the invention is further treated, for instance through screening, whereafter, for instance, the protein, peptides, amino acids, and other components or content substances in the juice are recovered by, for instance, coagulation through, for instance, acid and/or heat treatment. The juice stream may also be further processed by (ultra or membrane) filtration, drying, fermentation, or other methods known to those skilled in the art. Protein-rich or otherwise high-grade nutrients for human and animal consumption, but also pigments such as carotene (provitamin A) can be recovered from cytosol in this way, also from that of leaf and/or stem parts.

Also eligible for processing in a method according to the invention is vegetable material not belonging to cultivated crops in the strict sense of the word, such as roadside grass mown along roads or highways, or mixtures of grasses and other wild plants mown in natural areas.

The invention further provides a method for separating components from vegetable material which has been harvested a relatively long time ago and has already, at least partly, dried out, or which can no longer be qualified as fresh and green, but has acquired a more woody and/or dry character for instance through maturation. Such material is not suitable for processing in a pressing method, but is now outstandingly processable, since the extent of turgor of the plant cell to be accessed is not important when a method according to the invention is used.

The invention provides a refiner, or an apparatus of comparable action, and the use of such an apparatus, for instance for separating components from vegetable material which does not (yet) exhibit any lignification, or exhibits only a minor extent of lignification, and in which parenchyma is present. This parenchyma with the cytosol present therein is the basis of the juice stream as contemplated by the invention. A refiner is generally used to break down wood chips into fibers for the purpose of making pulp for the production of paper and/or cardboard. The invention provides for the processing by means of a refiner, of a crop selected from a large variety of crops which traditionally have not been processed with a refiner. Refiners are generally not used for fresh and/or green material, since wood consists principally of dead or lignified tissue from which most parenchyma, with chloroplasts, has disappeared. Different types of refiners are known to those skilled in the art. There are, for instance, refiners with conical disks or with flat disks. The invention provides for the use of both types, and/or equivalent apparatuses, for instance convex/concave type composite grinding disks, in a method provided by the invention.

The invention will now be further explained in the experimental section of the description, without limiting it.

Experimental Section

Experimentally, the invention was compared with the traditional technique. This was done using a lab(oratory) protocol and industrial equipment. On the basis of that, the nature of the fiber fraction can be assessed and the recoverability of content substances in the two methods can be compared. Results shown hereinbelow illustrate the difference in the recoverability of protein and other content substances.

Traditional Method

In the experiments on a laboratory scale, the traditional method of grinding and pressing was simulated by pulping material in a Tecator Homogenizer and squeezing the pulp using an adapted draw pressure bench of Lloyd Instruments. It was provided with a cup having a perforated bottom plate (surface 50 $cm^2$) in which 100 g of fresh pulp were pressed for 15 minutes at a pressure running up to 10 bar. The original material and the press juice were analyzed for nitrogen content, and the recoverability of protein was calculated as the amount of crude protein (amount of nitrogen multiplied by 6.25) in juice expressed as a percentage of the amount of crude protein in the original material.

On a larger scale, a hammer mill of the type Jenz A30 was employed to disintegrate grass and the thus obtained grass pulp was squeezed in a Vetter screw press with a compression ratio of 1:7.65 and a perforation of the cylinder wall of 0.7 mm. By passing plant material through the hammer mill a single time or several times, the material could be disintegrated to a greater or lesser extent.

New Method

In the experiments on a laboratory scale, the new method was simulated by fine-chopping fresh grass in a cutter, then mixing 30 g of fine-cut grass pieces with 400 ml of water, and fiberizing same in a blender (Braun mixer) for 10 minutes, screening the slurry from the blender on an 850 micron screen, and washing and drying the screened-off fiber fraction. The fiber was analyzed for contents of nitrogen, ash and cell walls and thus the composition of the defibered slurry was calculated. The fiber yield was determined as the amount of dry matter in the fiber fraction as a percentage of the amount of dry matter in the starting material. The recoverability of protein was calculated as the amount of crude protein in the defibered slurry expressed as a percentage of the amount of crude protein in the original material.

The new method was also tested with a Sprout-Waldron 12 inch pressure refiner, with grinding disks of the type D2A505. Refining or fiberizing fresh grass was done under atmospheric conditions at a disk distance of 0.04 mm, with addition of water to a consistency of about 2% dry matter. The fiber was then screened on a screen with 140 micron openings.

The new method was also tested on a semitechnical scale using a Sunds Disk Refiner type RO 20 FLUFF serial no. 3838, year of manufacture 1985, provided with grinding disks with a high or low resistance to throughput. With this refiner, inter alia the effect of disk type and disk distance on throughput and fiber composition was investigated.

Refining occurred under atmospheric conditions with chopped grass, with or without addition of water. The fiberization of potato tops was also tested.

The grass originated from both cultivated grassland and natural grounds and was processed in fresh, chopped form. Samples of the fiberi7ed material were rinsed by hand and screened and analyzed for nitrogen and ash content. The recoverability of crude protein was calculated on the basis of an average fiber proportion of 33% of the grass dry matter.

The potato tops originated from starch potato plants during the full growth phase of the potato plant. The tops were pulled mechanically and were consequently crashed to crushed to some extent. The potato tops consisted of stems and leaves. The potato tops, without prior washing, were processed with the refiner while fresh, without addition of water. The fiberized material was squeezed by hand.

Experimental Results

Press cake of grass (left) and grass fiber (right) stemming from perennial ryegrass (Lolium perenne).

In the press cake, the green color due to the presence of chloroplasts is conspicuous. Also, leaf fragments are recognizable by their size (cross section greater than 1 mm) and the characteristic ribs on the top of the leaf. The grass fiber is distinguished by the light color (virtually complete absence of chloroplasts), the filamentary structure and the small diameter of the individual fibers (in this case very much smaller than 1 mm). The distance between successive numbers is 1 cm.

FIG. 3

Suspension of grass fiber from perennial ryegrass (Lolium perenne).

Visible are fibrous structures (vascular bundles) of a diameter of a few tens of micrometers and epidermis sheets of a smallest diameter of up to a few hundreds of micrometers.

FIG. 4

Microscopic recording of epidermis in grass fiber originating from perennial ryegrass (Lolium perenne).

Characteristic is the presence of stomata in perennial ryegrass, concentrated in the epidermis of the top of the leaf. The more compact tissue on the side of the stomata is underling sclerenchyma. The elongate epidermis cells have a cross section of about 20 micrometers.

FIG. 5

Microscopic recording of vascular bundles in grass fiber originating from perennial ryegrass (Lolium perenne).

Characteristic of vascular bundles are their being built up from several cells and the presence of vessels with reticulate thickenings. The diameter of the fiber in the middle of the figure is about 50 micrometers.

FIG. 6

Microscopic recording of parenchyma cells in the juice stream of defibered grass originating from perennial ryegrass (Lolium perenne). This juice stream belongs to the fiber fraction of FIGS. 1 and 2.

Characteristic of parenchyma cells in grass leaves is the abundant (it presence of chloroplasts. Some parenchyma cells, however, have been broken during fractionation: only the cell wall is still visible, the chloroplasts occur in isolation in the surrounding fluid. The size of these parenchymal cells is about 20*40 micrometers. The fraction shown in this figure was diluted prior to being photographed to bring out the to relatively large amount of parenchyma cells in the juice stream according to the invention.

FIG. 7

Microscopic recording of parenchyma cells in press juice from grass originating from perennial ryegrass (Lolium perenne).

Figure 1:
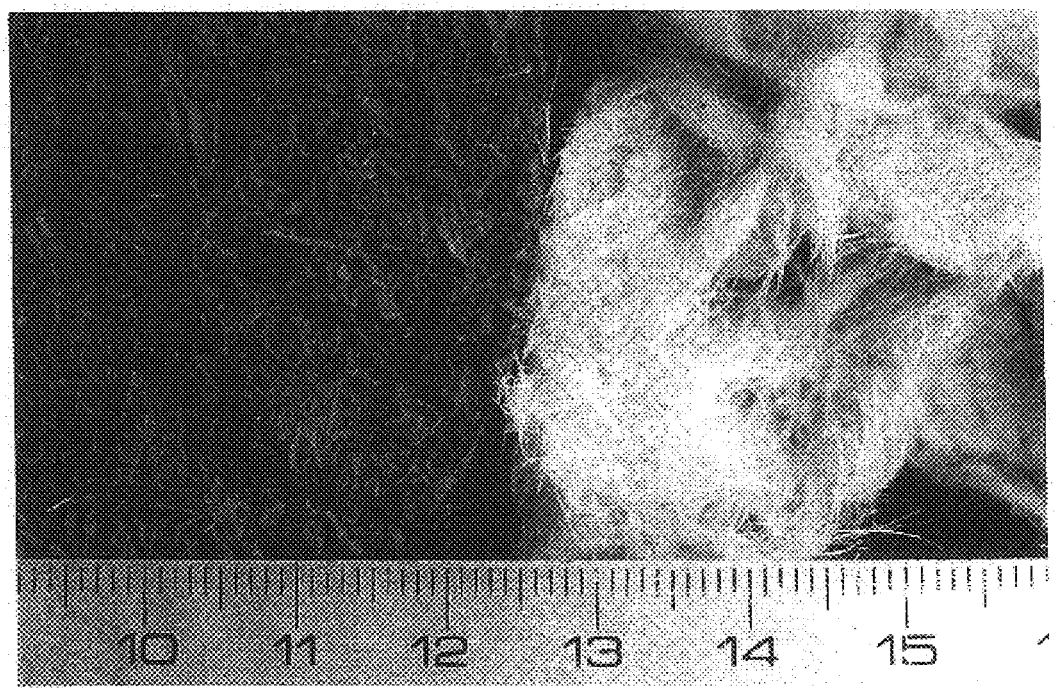
FIG. 1 and FIG. 2 (detail)
Figure 2:
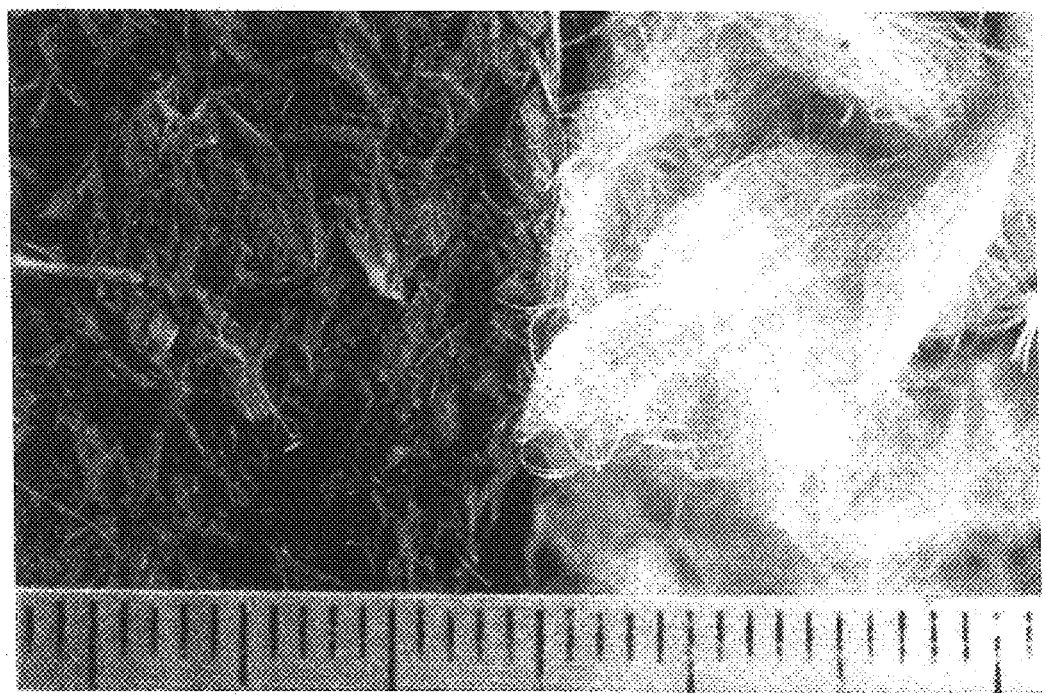
Figure 3:
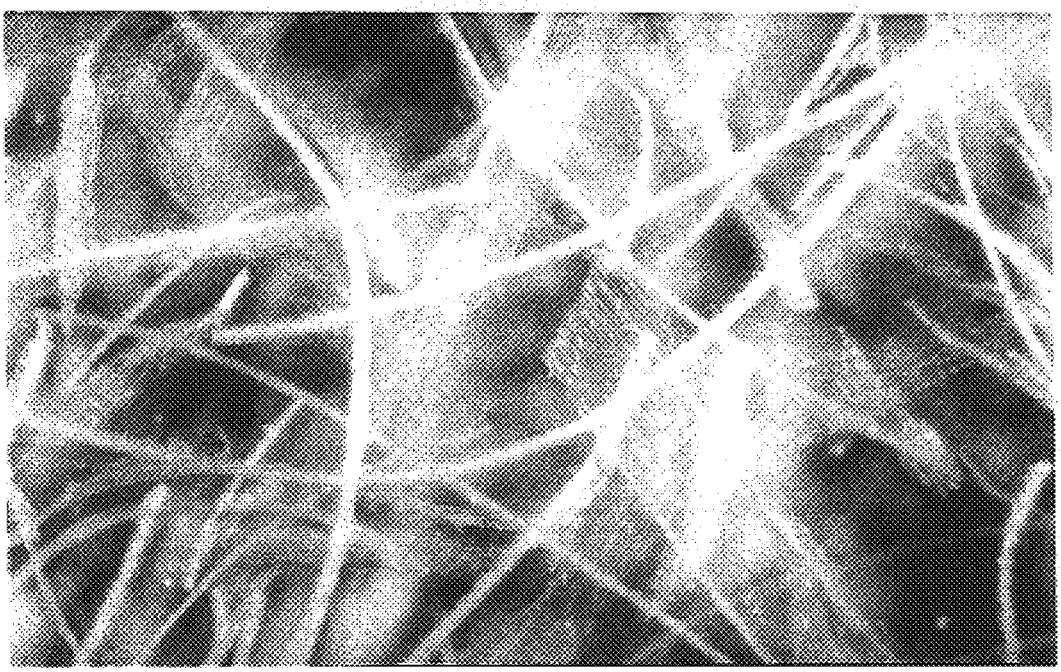
Figure 4:
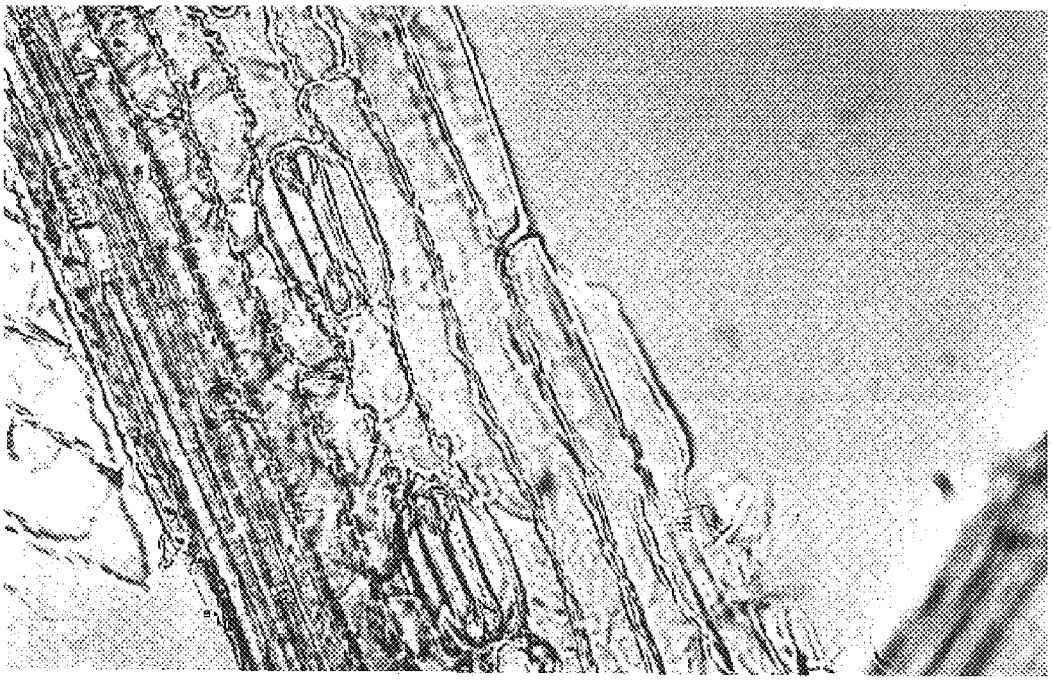
Figure 5:
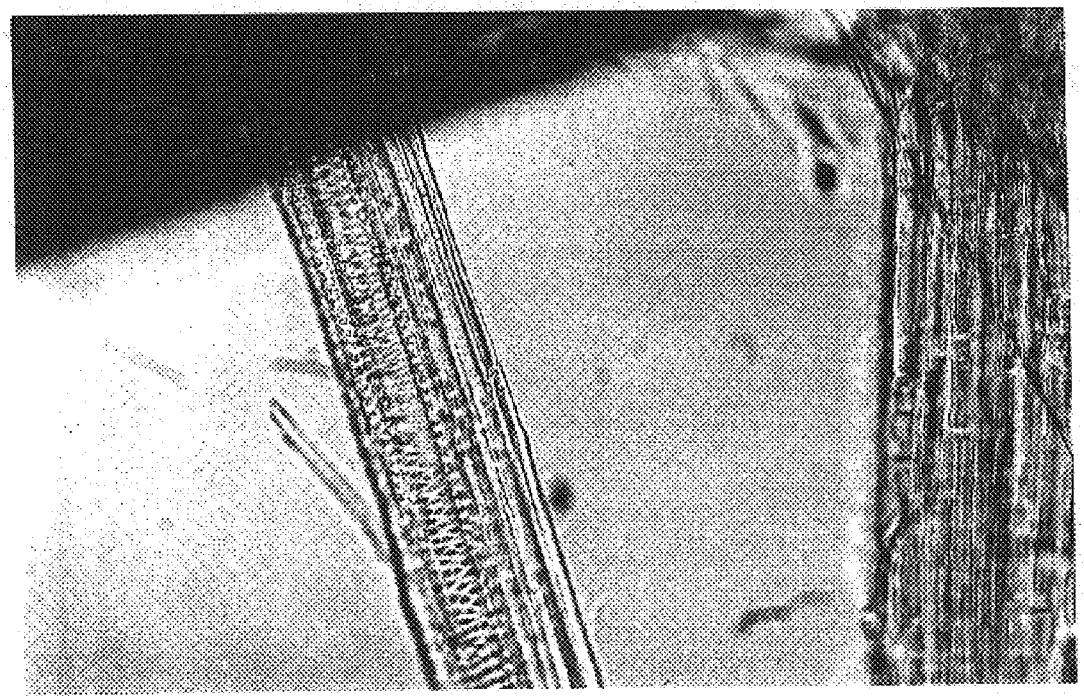
Figure 6:
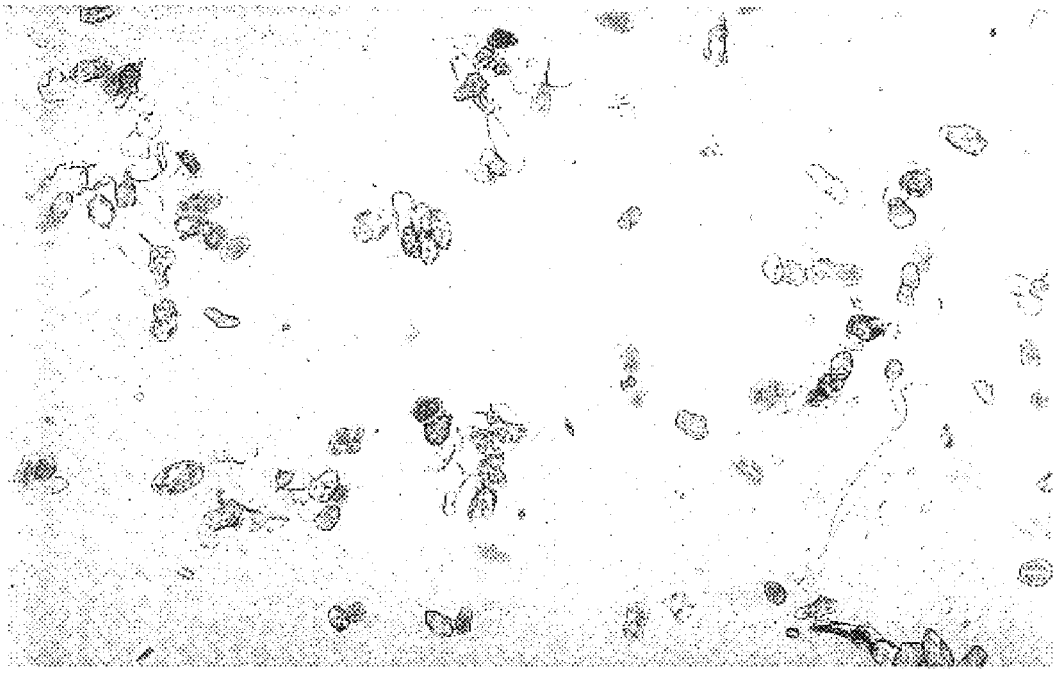
Figure 7:
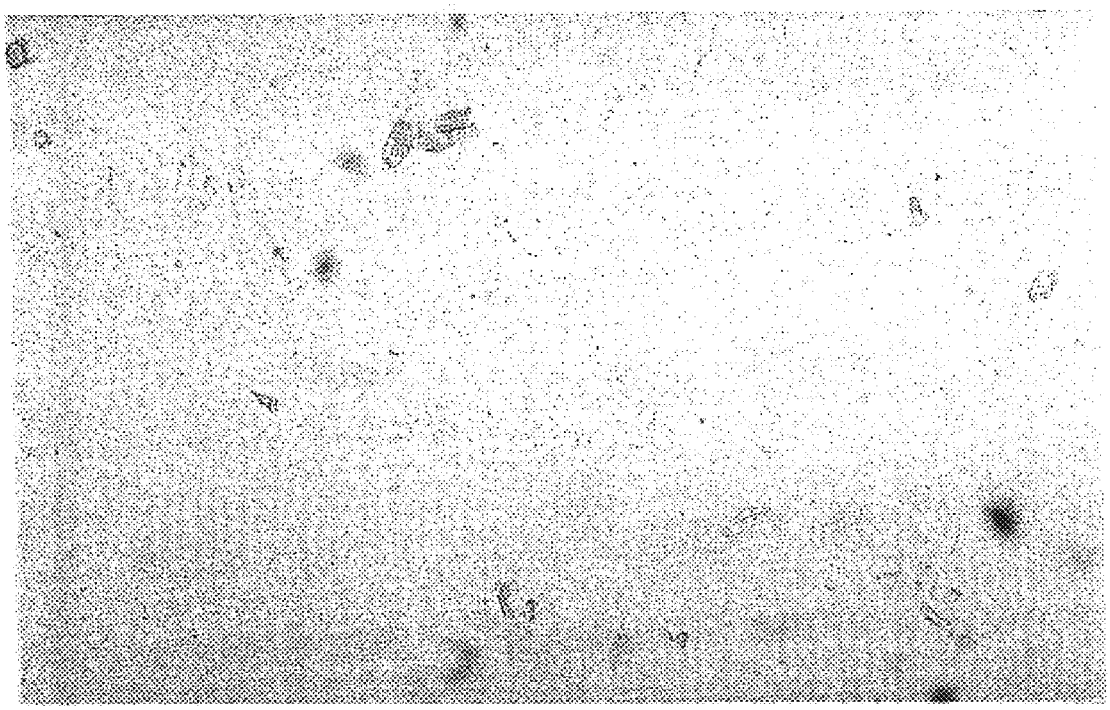

This press juice belongs to the press cake of FIGS. 1 and 2. The fraction shown in this figure was concentrated prior to being photographed to bring out the relatively small amount of parenchyma cells in the press juice.

FIG. 8

Process diagram for fiberizing or refining grass.

FIG. 9

Process diagram for fiberizing or refining grass.

FIG. 10

Process diagram for fiberizing or refining grass.

Fiberization

TABLE 1

Fiber composition and fiber yield of cultivated grasses, by species and variety, on average during the season, and of a few other crops.

| Species/variety | Nitrogen content (g/kg dm**) | Ash content (g/kg dm) | Cel wall content (g/kg dm) | Fiber yield % of dry matter in raw material |
|---|---|---|---|---|
| Grasses | | | | |
| *Lolium perenne* 4n Vr.* | 4.0 | 50.6 | 867 | 28 |
| *Lolium perenne* 2n Vr. | 4.3 | 43.5 | 865 | 34 |
| *Lolium perenne* 4n Lt. | 4.5 | 41.1 | 879 | 29 |
| *Lolium perenne* 2n Lt. | 5.4 | 34.7 | 857 | 29 |
| *Lolium multiflorum* 4n | 3.8 | 47.4 | 877 | 24 |
| *Lolium multiflorum* 2n | 4.4 | 36.6 | 880 | 27 |
| *Phleum pratense* | 4.3 | 39.8 | 862 | 30 |
| *Festuca arundinacea* | 4.4 | 36.7 | 867 | 29 |
| *Dactylis glomerata* | 5.1 | 42.0 | 873 | 32 |
| *Festuca pratensis* | 4.5 | 44.2 | 872 | 32 |
| Other plant materials | | | | |
| Lucerne | 5.7 | 18.9 | 824 | 28 |
| Potato tops young | 4.2 | 26.1 | 836 | 16 |
| Potato tops old | 3.7 | 50.7 | 714 | 21 |
| Pea tops | 4.8 | 25.7 | 832 | 29 |
| Beet tops | 12.0 | 79.7 | 680 | 9 |

*4n = tetraploid; 2n = diploid; Vr. = early-flowering; Lt. = late-flowering
**dm: dry matter Fiberizing vegetable biomass yields a fiber fraction which, depending on the nature of the material, can vary from less than 10% to more than 30% of the dry matter. The exact number is also dependent on the mesh of the screen with which the fiber is separated and the intensity of washing. The fiber fraction in the case of Lolium perenne typically consists for more than 80% of cell wall material and has a nitrogen content mostly lower than 6–8 g per kg of dry matter and an ash content mostly lower than 50–100 g per kg of dry matter.

TABLE 2

Composition of fiber

| | refiner | lab protocol |
|---|---|---|
| Ash (g/kg d.m.) | 22.3 | 26.0 |
| Nitrogen (g/kg d.m.) | 5.3 | 4.4 |
| Cell walls (g/kg d.m.) | 808 | 792 |

The composition of the fiber fraction is comparable for the experiments with the refiner and the experiments according to the lab protocol.

Defibration

TABLE 3

Composition of grass and of the defibered grass slurry.

| | Grass | Defibered slurry | |
|---|---|---|---|
| | | refiner | lab protocol |
| Ash (g/kg d.m.) | 92.6 | 138 | 139 |
| Nitrogen (g/kg d.m.) | 31.0 | 47.4 | 48.7 |
| Cell walls (g/kg d.m.) | 544 | 375 | 438 |

In addition to the cell content constituents (such as protein), the defibered slurry also contains a part of the cell walls form the plant material. These are substantially the cell walls from the soft parenchymal tissue which disintegrate upon fiberization and subsequently, in defibration, pass the screen as finely dispersed material. The amount present in the defibered slurry is partly dependent on the diameter of the screen orifices.

TABLE 4

Recoverability of crude protein from cultivated grasses, by species and variety, on average during the season, and of a few other plant materials, upon grinding + pressing and upon defibration.

| Species/variety | Grinding + pressing (%) | Defibration (%) |
|---|---|---|
| Grasses | | |
| *Lolium perenne* 4n Vr. | 30 | 95 |
| *Lolium perenne* 2n Vr. | 23 | 94 |
| *Lolium perenne* 4n Lt. | 22 | 95 |
| *Lolium perenne* 2n Lt. | 16 | 94 |
| *Lolium multiflorum* 4n | 41 | 96 |
| *Lolium multiflorum* 2n | 35 | 95 |
| *Phleum pratense* | 11 | 94 |
| *Festuca arundinacea* | 21 | 94 |
| *Dactylis glomerata* | 31 | 93 |
| *Festuca pratensis* | 17 | 94 |
| Other materials | | |
| Lucerne | 52 | 95 |
| Potato tops young | 51 | 98 |
| Potato tops old | 42 | 95 |
| Pea tops | 16 | 95 |
| Beet tops | 24 | 95 |

Defibration yields a slurry mostly containing more than 70%, and preferably more than 80% or 90%, of all crude protein from the vegetable material. This protein can be recovered from it by centrifugation, which may or may not be preceded by heat coagulation.

In the traditional method of fractionation, the recoverability of crude protein is mostly less than 50%.

TABLE 5

Comparison of protein recoverability from grass upon repeated passage through hammer mill followed by pressing in a screw press, and upon fiberization according to the invention.

| Hammer mill + screw press Passages through hammer mill | Protein recoverability (%) |
|---|---|
| 1x | 28 |
| 2x | 30 |
| 4x | 35 |
| 8x | 43 |
| Fiberization according to the invention | 93–96 |

Even upon repeated disintegration of grass in a hammer mill followed by pressing in a screw press, the protein recoverability was found to be less than half of the protein recoverability measured upon fiberization of grass.

The results of the tests with the Sunds Disk Refiner are summarized in Table 6.

Choice of plate type and disk distance determine the extent of fiberization but determine protein recoverability only to a slight extent. A high throughput was possible in combination with a high protein recoverability (in this case >85%) both with protein-rich cultivated grass and with protein-low natural grass.

Potato tops are well processable with the refiner. In the fiber fraction the content of woody fibers is relatively high because the original potato tops consisted not only of leaf tissue but also of stem tissue. The high ash content in the fibers of the potato tops was caused to an important extent by the high sand content in the tops due to not washing the raw material.

enzymatic activity (blanching effect) and inhibit formation of polyphenols.

Figure 8:
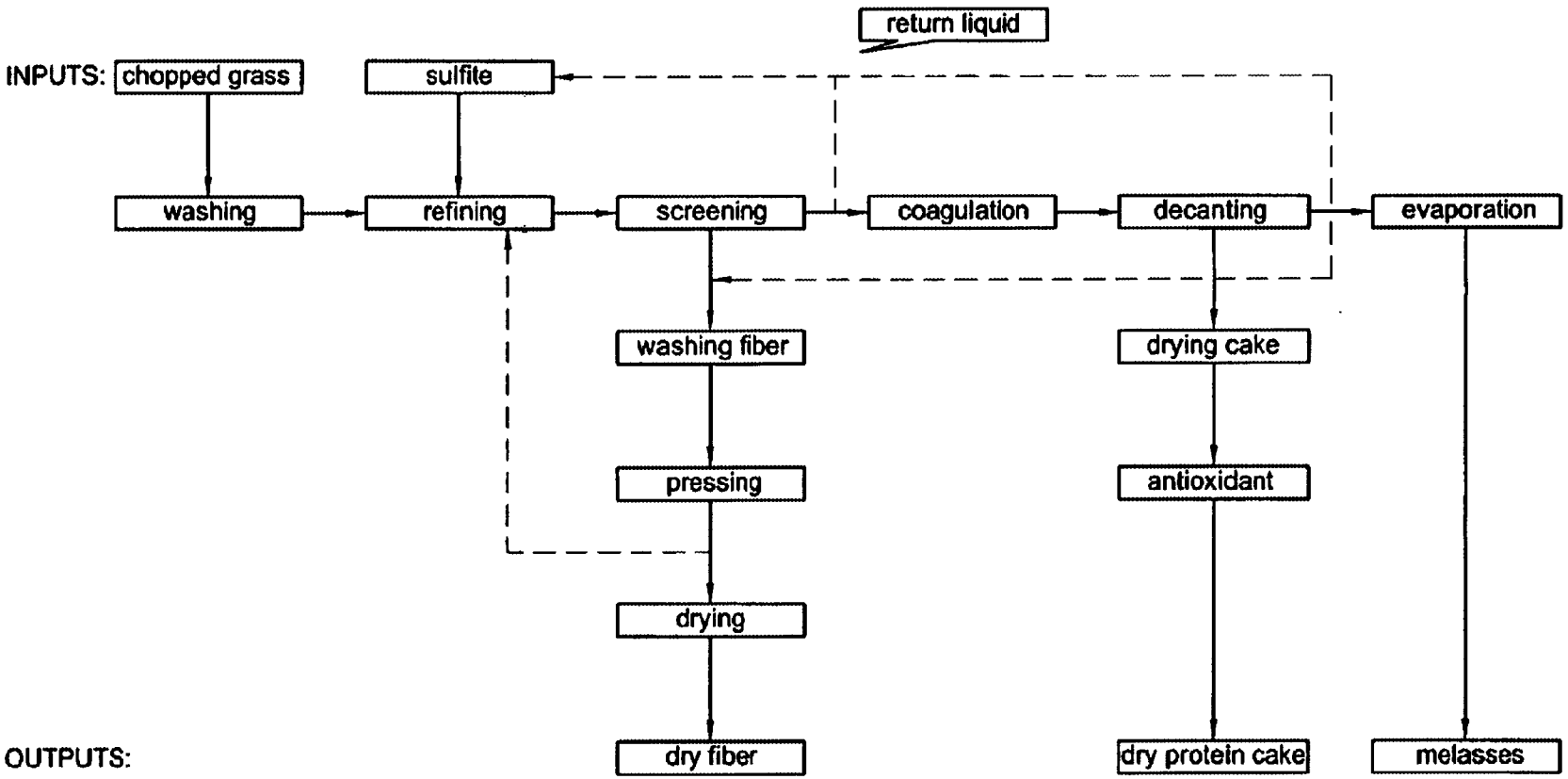

Refining: basic diagram (FIG. 8)

Refining grass is in principle possible with and without liquid addition during refining. In a first test, with fresh grass (15% dry matter), the process did not proceed readily without generous admixture of water to a dry matter percentage of about 2%. The necessity of liquid addition is probably partly dependent on the type of refiner and the nature of the grass (fibrousness). Pressed grass (26% dry matter) could be refined without water addition. If, and if so, how much water is admixed, has consequences for the temperature rise during refining, and therefore for the extent of protein denaturation and hence for the subsequent steps in the process.

The basic diagram includes, after refining, the process steps: screening out the fiber, heat coagulating the refiner

TABLE 6

Fiber composition and protein recoverability upon accessing grass and potato tops on a semitechnical scale using a Sunds Disk Refiner.

| | composition raw material | | | disk | | | composition fiber | | protein |
|---|---|---|---|---|---|---|---|---|---|
| Raw material | d.m. (g/kg fresh) | ash (g/kg d.m.) | N (g/kg d.m.) | Plate resistance | disk distance mm | through-put (kg d.m/hour) | ash (g/kg d.m.) | N (g/kg dm) | recoverability (%) |
| cultivat. grass | 154 | 91 | 19.3 | high | 0.4 | — | 13 | 5 | 91 |
| cultivat. grass | 142 | 183 | 36.1 | high | 0.10 | 39 | 31 | 14 | 87 |
| " | " | " | " | high | 0.50 | 55 | 27 | 15 | 86 |
| " | " | " | " | high | 1.00 | 104 | 38 | 15 | 86 |
| " | " | " | " | low | 0.05 | 157 | 49 | 14 | 87 |
| " | " | " | " | low | 0.10 | 135 | 41 | 14 | 87 |
| " | " | " | " | low | 0.50 | 139 | 54 | 15 | 86 |
| " | " | " | " | low | 1.00 | 211 | 82 | 20 | 82 |
| natural grass | 215 | 138 | 12.1 | low | 0.10 | — | 41 | 6 | 84 |
| potato tops | 104 | 342 | 23.5 | high | 0.20 | — | 473 | 15.2 | — |
| " | 119 | 344 | 27.0 | low | 0.20 | — | 374 | 19.0 | — |

Process Diagrams for Refining Grass

Pretreatment

The appended process diagrams (see FIGS. 8 to 10) start from the supply of chopped grass as is also conventional in the processing of grass and lucerne in herbage dryers. Normally, the chopping length is in the order of magnitude of a few centimeters, but it can also be longer or shorter. For the refiner test, fresh grass was pre-comminuted in a Pierret guillotine cutter to 6 mm particle length, in other words, very short. Presumably, such a short length is not requisite; refining or fiberizing squeezed grass (of a particle length of presumably a few centimeters) did not present any problems.

Washing

A washing step will probably be necessary in practice to remove sand and thereby reduce equipment wear and enable a cleaner product yield. This washing step, however, may be skipped if sand and other contaminants are not present.

Sulfite Addition

Addition of sulfite may be necessary, but need not be so, to prevent undesirable complexing between proteins and polyphenols. On the basis of past experiences regarding the processing of grass juice, it is known that such complex formation reduces the nutritive values of grass proteins. The circumstances during refining, however, may be different. A rapid temperature rise during refining may instantly stop liquid followed by separation of the protein cake by means of a decanter and evaporation of the deproteinized liquid. Two extreme variants of this basic diagram are conceivable: one with a minimal addition of liquid during refining and one with ample addition of liquid. The basic diagram is then changed to variant A (FIG. 9) and variant B (FIG. 10), respectively.

Figure 9:
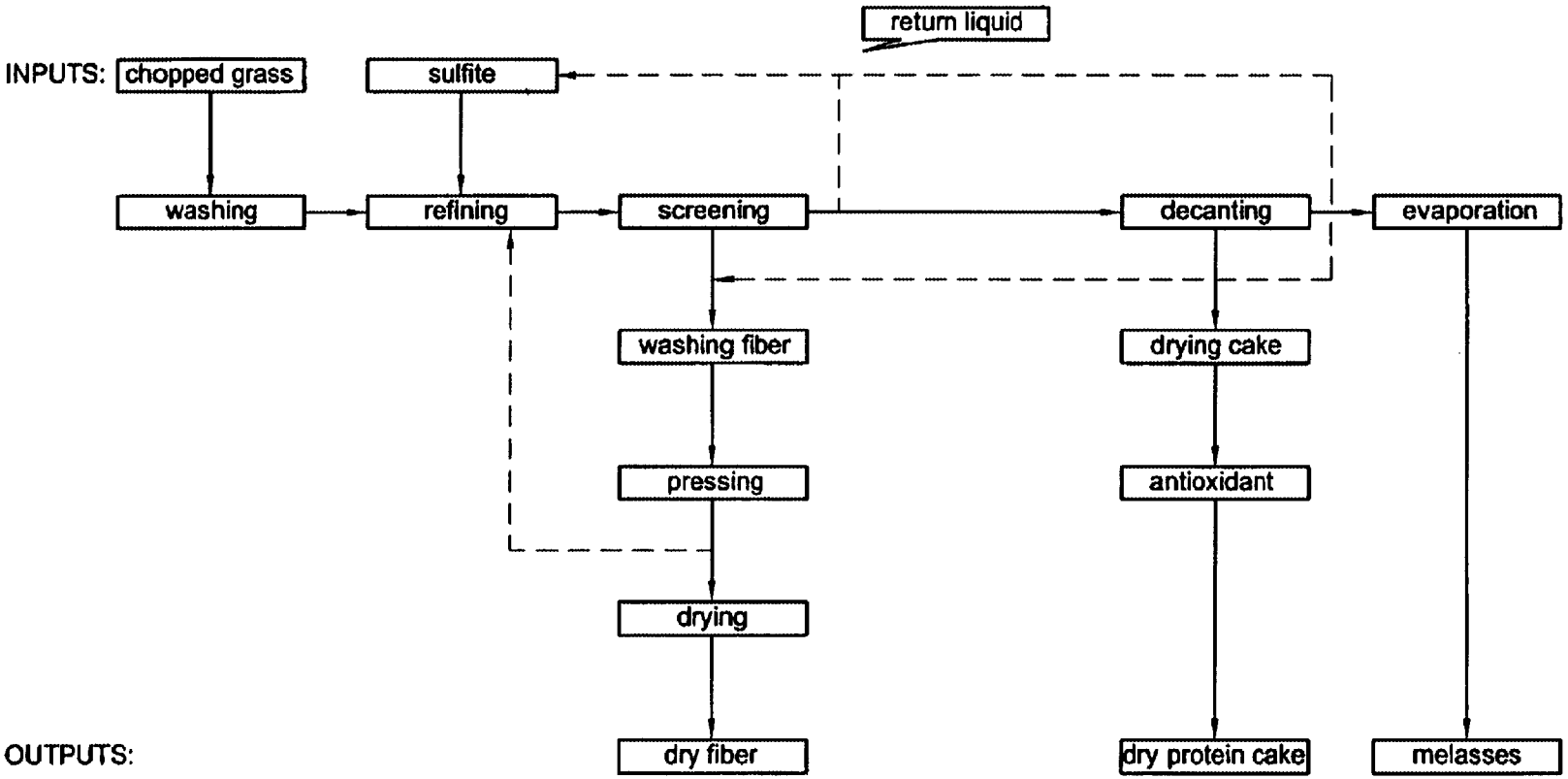
Figure 10:
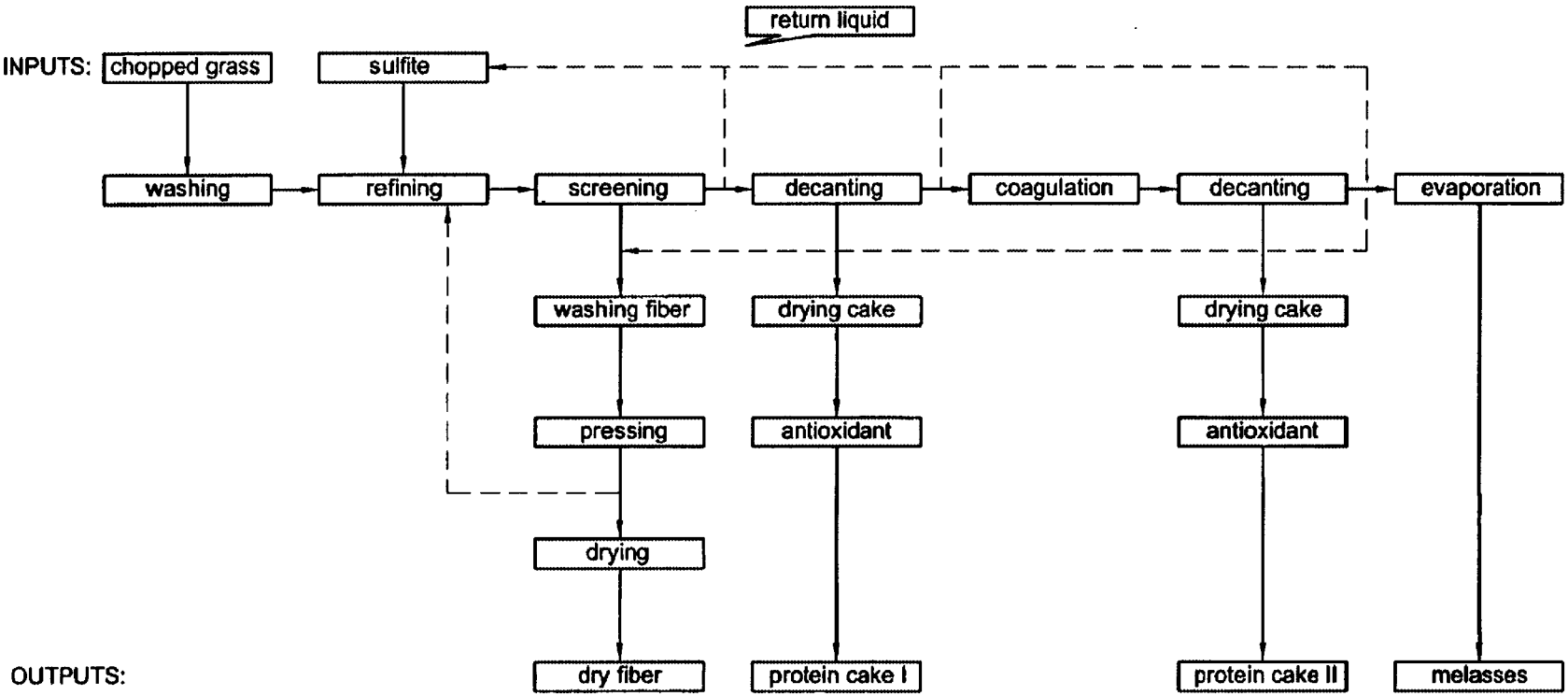

Refining: variant A (FIG. 9)

Upon minimal addition of return liquid, possibly a substantial temperature rise will occur during refining: in the test with pressed grass to above 70° C. Protein coagulation and pasteurization will then occur already during refining and possibly a separate coagulation step may then be skipped. In that case, the process diagram is simplified to refining—screening—decanting—evaporation: see variant A on basic diagram.

Refining: variant B (FIG. 10) Variant B: In case of ample addition of return liquid, the temperature rise during refining can remain limited: in the test with fresh grass to about 35° C. As a result, presumably, a part of the protein can remain in solution. In that case, after refining, two alternative routes are conceivable. The simplest one is, after screening out the fiber, to heat-coagulate the liquid and decant. In that case, one protein cake is formed and a deproteinized liquid that can be evaporated (see the basic diagram). A more complex route (variant B) comprises, after screening out the fiber, initial decanting whereby a crude protein cake is obtained (crude, i.e. with admixture of finely divided parenchymal cell walls that pass the screen), followed by heat-coagulation and decanting again. In this second decanting step, a purer protein cake is obtained.

Screening out the Fibers

For the purpose of screening out the fibers, centriscreens can be employed, as known to those skilled in the art for separating potato fiber. In the test, an inclined screen was used, having stretched onto it a wire gauze with openings of 140*140 microns. On a lab scale, a screen with a hole diameter of 850 and 250 microns was used. Experiences with it are that most fibers can be separated on a relatively coarse screen. The finer fiber fraction can be added to the total fiber fraction or, via enzymatic deliquescence, to the molasses, concentrate or juice stream.

Washing and Drying of Fiber

The fiber that is separated by screening may be contaminated with dissolved and suspended substance. Accordingly, washing with deproteinized return liquid is then necessary, followed by moisture removal through pressing/centrifugation and drying.

Drying Protein Cake

The protein-rich cake which is separated through decanting can be dried in the same manner as is known to those skilled in the art for, for instance, potato protein. In case of the presence of a relatively high lipid fraction, addition of an antioxidant product has an improving effect.

Evaporation of Deproteinized Liquid

The deproteinized liquid can be evaporated to form a sugar-rich syrup.

Extended Procedure

The basic diagram can be expanded to include processes for the purpose of further refining the crude protein cake. One possible addition is enzymatic deliquescence of the parenchymal cell walls in the crude protein cake. The sugars which this yields can, for instance, be added to the molasses, concentrate or juice stream.

What is claimed is:

1. A method for separating virtually completely cytosolic and parenchyma components from relatively firm tissues (vascular bundles, sclerenchyma, epidermis) of vegetable material having at least leaf and/or stem parts comprising:

a) at least partially fiberizing said vegetable material by means of a refiner to dissociate virtually completely all cytosolic and parenchyma materials from relatively firm tissues and b) subsequently separating said at least partially fiberized material into i) a fiber fraction comprising relatively firm tissues, and ii) a juice stream comprising soft tissues.

2. A method according to claim 1, wherein the juice stream comprises chloroplasts.

3. A method according to claim 1, wherein the fiber fraction is separated from the juice stream comprising one of screening, centrifugation, processing by hydro(cyclone), centriscreening, decanting, sedimentation, or combinations thereof.

4. A method according to claim 1, wherein the vegetable material originates from a cultivated crop.

5. A method according to claim 4, wherein the cultivated crop belongs to the family of grasses.

6. A fiber fraction obtained by a method for separating virtually completely cytosolic and parenchyma components from relatively firm tissues (vascular bundles, sclerenchyma, epidermis) of vegetable material having at least leaf and/or stem parts comprising:

a) at least partially fiberizing said vegetable material by means of a refiner to dissociate virtually completely all cytosolic and parenchyma materials from relatively firm tissues and b) subsequently separating said at least partially fiberized material into i) a fiber fraction comprising relatively firm tissues, and ii) a juice stream comprising soft tissues.

7. A biodegradable product comprising a fiber fraction obtained by a method for separating virtually completely cytosolic and parenchyma components from relatively firm tissues (vascular bundles, sclerenchyma, epidermis) of vegetable material having at least leaf and/or stem parts comprising:

a) at least partially fiberizing said vegetable material by means of a refiner to dissociate virtually completely all cytosolic and parenchyma materials from relatively firm tissues and b) subsequently separating said at least partially fiberized material into i) a fiber fraction comprising relatively firm tissues, and ii) a juice stream comprising soft tissues.

8. A biodegradable product according to claim 7, wherein said product is paper.

9. A biodegradable product according to claim 7, wherein said product is cardboard.

10. A biodegradable product according to claim 7, wherein said product is fiberboard.

11. A biodegradable product according to claim 7, wherein said product is used in the preparation of a moisture absorbing material.

12. A biodegradable product according to claim 7, wherein said product is used in the preparation of growth media.

13. A biodegradable product according to claim 7, wherein said product is a soil improver.

14. A biodegradable product according to claim 7, wherein said product is fuel to produce energy.

15. A juice stream obtained by a method for separating virtually completely ctosolic and parenchyma components from relatively firm tissues (vascular bundles, sclerenchyma, epidermis) of vegetable material having at least leaf and/or stem parts comprising:

a) at least partially fiberizing said vegetable material by means of a refiner to dissociate virtually completely all cytosolic and parenchyma materials from relatively firm tissues and b) subsequently separating said at least partially fiberized material into i) a fiber fraction comprising relatively firm tissues, and ii) a juice stream comprising soft tissues.

16. A juice stream according to claim 15, which contains more than 55% of the crude protein of the vegetable material.

17. A juice stream according to claim 16, which contains preferably more than 75% of the crude protein of the vegetable material.

18. A juice stream according to claim 17, which contains preferably more than 90% of the crude protein of the vegetable material.

19. A protein enriched product comprising a juice stream obtained by a method for separating virtually completely cytosolic and parenchyma components from relatively firm tissues (vascular bundles, sclerenchyma, epidermis) of vegetable material having at least leaf and/or stem parts comprising:

a) at least partially fiberizing said vegetable material by means of a refiner to dissociate virtually completely all cytosolic and parenchyma materials from relatively firm tissues and b) subsequently separating said at least partially fiberized material into i) a fiber fraction comprising relatively firm tissues, and ii) a juice stream comprising soft tissues.

20. A protein enriched product according to claim 19, wherein said product is food.

21. A protein enriched product according to claim 20, wherein said food is for human nourishment.

22. A protein enriched product according to claim 20, wherein said food is for use in livestock feeding.

23. A protein enriched product according to claim 19, wherein said product is a substrate for fermentation.

24. A protein enriched product according to claim 19, which results from recovering or purifying a substance contained in said juice stream.

25. An apparatus for separating virtually completely cytosolic and parenchyma components from relatively firm tissues (vascular bundles, sclerenchyma, epidermis) of vegetable material having at least leaf and/or stem parts comprising:

a) a refiner which dissociate virtually completely all cytosolic and parenchyma materials form said relatively firm tissues, and b) a separator which separates the fiber fraction from the juice stream.

* * * * *

UNITED STATES PATENT AND TRADEMARK OFFICE

CERTIFICATE OF CORRECTION

PATENT NO. : 6,800,319 B1
DATED : October 5, 2004
INVENTOR(S) : Hulst et al.

It is certified that error appears in the above-identified patent and that said Letters Patent is hereby corrected as shown below:

Column 9,
Line 64, now reads "fiberi7ed…", and
should read -- fiberized… --

Column 10,
Line 60, now reads "abundant (it presence…", and should read -- abundant presence… --

Signed and Sealed this

Twenty-sixth Day of April, 2005

JON W. DUDAS
*Director of the United States Patent and Trademark Office*

UNITED STATES PATENT AND TRADEMARK OFFICE

CERTIFICATE OF CORRECTION

PATENT NO. : 6,800,319 B1
DATED : October 5, 2004
INVENTOR(S) : Hulst et al.

It is certified that error appears in the above-identified patent and that said Letters Patent is hereby corrected as shown below:

Column 9,
Line 64, now reads "fiberi7ed…", and should read -- fiberized… --

Column 10,
Line 60, now reads "abundant (it presence…", and should read -- abundant presence… --

Signed and Sealed this

Third Day of May, 2005

JON W. DUDAS
*Director of the United States Patent and Trademark Office*